US006999042B2

(12) United States Patent
Dearnley et al.

(10) Patent No.: US 6,999,042 B2
(45) Date of Patent: Feb. 14, 2006

(54) LOW VISUAL IMPACT MONOPOLE TOWER FOR WIRELESS COMMUNICATIONS

(75) Inventors: Russell W. Dearnley, Naperville, IL (US); Bob Elliot, Naperville, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/377,832

(22) Filed: Mar. 3, 2003

(65) Prior Publication Data

US 2004/0174317 A1 Sep. 9, 2004

(51) Int. Cl.
*H01Q 1/12* (2006.01)

(52) U.S. Cl. ..... 343/890; 343/891; 343/853

(58) Field of Classification Search ..... 343/890, 343/891, 892, 853, 797

See application file for complete search history.

(56) References Cited

U.S. PATENT DOCUMENTS

| | | | | | |
|---|---|---|---|---|---|
| 3,605,105 | A | | 9/1971 | Penzias | 343/839 |
| 3,605,108 | A | | 9/1971 | Crawford | 343/882 |
| 3,829,864 | A | | 8/1974 | Truskanov et al. | 343/833 |
| 4,301,457 | A | | 11/1981 | Bogner | 343/770 |
| 4,574,290 | A | | 3/1986 | Siwiak | 343/827 |
| 4,590,479 | A | | 5/1986 | Ben-Dov | 343/771 |
| 5,038,151 | A | | 8/1991 | Kaminski | 343/727 |
| 5,291,211 | A | | 3/1994 | Tropper | 343/890 |
| 5,414,437 | A | * | 5/1995 | Mahnad | 343/770 |
| 5,467,955 | A | | 11/1995 | Beyersmith | 248/219.3 |
| 5,557,656 | A | * | 9/1996 | Ray et al. | 455/431 |
| 5,570,546 | A | | 11/1996 | Butterworth et al. | 52/111 |
| 5,581,958 | A | | 12/1996 | Cote | 52/40 |
| 5,611,176 | A | | 3/1997 | Juengert et al. | 52/40 |
| 5,641,141 | A | | 6/1997 | Goodwin | 246/218.4 |
| 5,757,324 | A | | 5/1998 | Helms et al. | 343/700 |
| 5,787,649 | A | | 8/1998 | Popowych et al. | 52/40 |

(Continued)

OTHER PUBLICATIONS

Inventor: Behr, *Antenna Tower*, patent application Publication No. US 2001/O045911, Publication Date: Nov. 29, 2001.

Andrew Corporation, *New Product Announcement, Cluster Mount Eases Zoning Approval*, Bulletin 10286A (4/99).

Inventors: Jimenez Sanchez et al., *Arrangement of Camouglage Applicable Over Support Towers of Telecommunications Antennas or Similar Structure*, patent application Publication No. US 2001/OD13212, Publication Date: Aug. 16, 2002.

(Continued)

*Primary Examiner*—Hoang V. Nguyen
(74) *Attorney, Agent, or Firm*—Wood, Herron & Evans, L.L.P.

(57) ABSTRACT

An antenna system incorporating at least two antennas circumferentially arranged with a side-by-side relationship about a monopole tower. The main beam direction of the radiation pattern emanating from each antenna may be remotely adjusted in elevation and/or azimuth. The main beam direction of the radiation pattern emanating from adjacent antennas may be varied independently. The antennas may be partitioned in one or more vertically-spaced groups each of which is arranged about a circumference of the monopole tower.

18 Claims, 5 Drawing Sheets

U.S. PATENT DOCUMENTS

| | | | | | |
|---|---|---|---|---|---|
| 5,818,385 | A | | 10/1998 | Bartholomew | 342/372 |
| 5,861,858 | A | | 1/1999 | Niekamp | 343/800 |
| 5,872,547 | A | | 2/1999 | Martek | 343/815 |
| 5,880,701 | A | | 3/1999 | Bhame et al. | 343/890 |
| 5,926,145 | A | | 7/1999 | Honma | 343/720 |
| 5,940,048 | A | | 8/1999 | Martek | 343/893 |
| 5,963,178 | A | | 10/1999 | Jones | 343/890 |
| 5,966,102 | A | * | 10/1999 | Runyon | 343/820 |
| 5,969,689 | A | | 10/1999 | Martek et al. | 343/758 |
| 5,995,063 | A | | 11/1999 | Somoza et al. | 343/890 |
| 5,999,145 | A | | 12/1999 | Niekamp | 343/890 |
| 6,028,566 | A | | 2/2000 | Pennell et al. | 343/878 |
| 6,057,804 | A | | 5/2000 | Kaegebein | 343/792 |
| 6,088,002 | A | | 7/2000 | Johnson et al. | 343/878 |
| 6,088,003 | A | | 7/2000 | Bassirat | 343/890 |
| 6,094,166 | A | | 7/2000 | Martek et al. | 343/374 |
| 6,111,553 | A | * | 8/2000 | Steenbuck | 343/891 |
| 6,122,866 | A | | 9/2000 | Thomas et al. | 52/40 |
| 6,127,988 | A | | 10/2000 | McNichol | 343/844 |
| 6,133,890 | A | | 10/2000 | Damiani | 343/890 |
| 6,172,654 | B1 | | 1/2001 | Martek | 343/893 |
| 6,173,537 | B1 | | 1/2001 | Davidsson et al. | 52/40 |
| 6,188,373 | B1 | | 2/2001 | Martek | 343/893 |
| 6,198,458 | B1 | | 3/2001 | Heinz et al. | 343/853 |
| 6,201,510 | B1 | | 3/2001 | Lopez et al. | 343/799 |
| 6,222,503 | B1 | | 4/2001 | Gietema et al. | 343/890 |
| 6,268,828 | B1 | | 7/2001 | Martek | 342/373 |
| 6,286,266 | B1 | | 9/2001 | Popowych et al. | 52/40 |
| 6,286,281 | B1 | | 9/2001 | Johnson | 52/592.1 |
| 6,323,823 | B1 | | 11/2001 | Wong et al. | 343/844 |
| 6,335,709 | B1 | | 1/2002 | Cummings | 343/890 |
| 6,343,440 | B1 | | 2/2002 | Ayers | 52/40 |
| 6,346,924 | B1 | | 2/2002 | Heinz et al. | 343/853 |
| 6,351,250 | B1 | | 2/2002 | Gillen | 343/890 |
| 6,369,774 | B1 | | 4/2002 | Lucidarme | 343/890 |
| 6,407,711 | B1 | | 6/2002 | Bonebright et al. | 343/705 |
| 6,694,698 | B1 | * | 2/2004 | Ryan | 52/741.1 |

OTHER PUBLICATIONS

Inventor: Gillen, *Antenna Tower and Support Apparatus*, patent application Publication No. US 2002/O015001, Publication Date: Feb. 7, 2002.

Inventors: Chiang et al., *Adaptive Antenna for Use in Wireless Communication Systems*, patent application Publication No. US 2002/O036595, Publication Date: Mar. 28, 2002.

Inventors: Ianello et al., *Antenna Mount*, patent application Publication No. US 2002/O053996, Publication Date: May 9, 2002.

Inventor: Cash, *Method and Apparatus for Increasing the Capacity and Stability of a Single–Pole Tower*, patent application Publication No. US 2002/O056250, Publication Date: May 16, 2002.

Inventor: Hook, *Group Antenna With Narrower Side Lobes in the Horizontal Plane*, patent application Publication No. US 2002/O057223, Publication Date: May 16, 2002.

Inventor: Wastberg, *Dual–Beam Antenna Aperture*, patent application Publication No. US 2002/O080073, Publication Date: Jun. 27, 2002.

Inventor: Skalina et al., *Common Aperture UHF/VHF Antenna*, patent application Publication No. US 2002/O084949, Publication Date: Jul. 4, 2002.

EMS Wireless, 1850 MHz–1990 MHz Product Catalog, Jan. 2001 (pp. 51, 52, 66–69, 71, 72, 74, 75, 77, 78, 80, 88, 89, 90, 93, 94, 96, 97 and 111).

EMS Wireless, 806 MHz –904 MHz Product Catalog, Summer, 2001 (pg. 125–128, 130, 131, 133, 142, 143, 146, 147, 149 and 150.

EMS Wireless, 1850 Mhz –1990 MHz Product Catalog, Aug. 2002 (pp. 28, 29, 75–93, 95, 108 , and 111.

* cited by examiner

LOW VISUAL IMPACT MONOPOLE TOWER FOR WIRELESS COMMUNICATIONS

FIELD OF THE INVENTION

The present invention relates generally to wireless communications systems and, more particularly, to a monopole-mounted antenna system in which constituent antennas are arranged circumferentially about a monopole tower such that the visual impact is reduced and in which the individual antennas have a remote electrically-adjustable main beam direction.

BACKGROUND OF THE INVENTION

Antenna towers have long been used for supporting antennas used in wireless communication networks, such as cellular communications systems. One common type of antenna tower is constructed of an interconnected lattice framework of steel beams. Another common type of antenna tower is a monopole tower consisting of a single tubular mast or pole extending upwardly from ground level. Monopole towers have grown in popularity because the visual impact of monopole towers is less than that of lattice-type towers and because of the relatively low cost as compared with lattice-type towers.

Wireless communication networks are divided into cells each arranged to communicate with mobile stations with minimal interference and that, in the aggregate, define a coverage area. A mobile station traversing the coverage area has its communications handed-off between adjacent cells. Each cell includes one or more individual antennas arranged and combined in a manner to communicate with a mobile station. Each antenna consists of multiple radiating elements that are housed within an outer housing, which may have a rectangular, box-like shape, that is affixed to a triangular support platform mounted to the monopole tower.

Changes in wireless coverage are accomplished by changing a main beam direction of the antenna. In most wireless communication networks, the main beam direction may be changed by an elevational or azimuthal adjustment after the antennas have been installed on the antenna tower. The main beam direction may be adjusted for varying the coverage area of each cell as the number of customers increases and additional cells are added to accommodate increasing numbers of mobile stations. The main beam direction may also be adjusted to compensate for new adjacent construction, vegetation growth, or other changes in the surrounding environment of the monopole tower.

One method for altering the main beam direction of the radiation pattern is to physically relocate the antennas and/or direction or to replace the antennas with certain fixed radiation characteristics with antennas having different fixed radiation characteristics. However, such physical relocation or replacement is difficult. Another method for altering the coverage is to mount the antennas to the antenna tower with brackets that allow mechanical adjustment of the downtilt of the individual antennas. However, service personnel must adjust the main beam direction of the antennas by climbing the tower to a service platform near the antennas or by being supported from an elevated lifting device such as a cherry picker. Not only is this costly, but wireless communications service is interrupted while the manual adjustment of the downtilt is being performed.

Operators of wireless communication networks typically need to obtain permission from residential and zoning boards to erect antenna towers. Antenna towers are by their very nature prominent structures. The preferred locations for antenna towers are the most visible locations relative to the surrounding landscape within the intended coverage area. Conventional monopole towers with triangular support platforms have an appearance that, while less objectionable than lattice-type towers, is not aesthetically pleasing. As a result, permission to erect an unsightly monopole tower may be difficult to obtain in urban and suburban venues. One approach for overcoming zoning opposition is to disguise or otherwise conceal the antennas and supporting platforms of the monopole tower to lessen the visual impact. For example, the monopole tower may be adorned with structures emulating foliage such that, to a casual observer, the tower resembles a tree or other vegetation. However, such camouflaging structures are impractical, difficult and expensive to construct, and costly to maintain.

Each wireless telephony provider in a geographical area requires their own dedicated cells to provide coverage. As a result, each provider will position their own set of towers in suitable sites within the geographic area. Because suitable sites are increasingly difficult to secure, more complex and visually objectionable antenna arrangements are being deployed to maximize coverage in the geographic area. In particular, the usage of the monopole tower may be increased by permitting multiple operators to share a single monopole tower. To that end, multiple operators may be accommodated by attaching additional triangular support platforms to the monopole tower and providing each platform with an additional set of antennas.

The number of antennas required to service multiple providers may be further reduced by diplexing individual providers on the same antennas. However, combining providers on a single antenna increases the likelihood of intermodulation distortion. In addition, the installation process for diplexed systems becomes more critical as, for example, a poorly-made jumper, a dirty connector or an improperly torqued connector may degrade performance. As the number of antennas servicing each antenna is limited, the ability to correct an antenna failure by simply changing to a spare antenna is limited. Furthermore, the duplexer adds losses that reduce coverage. Moreover, the coverage area for diplexed providers is identical and, as a result, variations in the main beam direction must be mutually agreed upon. Specifically, the main beam directions for two providers sharing antennas are not independently adjustable. Finally, the diplexing equipment is expensive and adds significantly to the system cost.

Therefore, it would be desirable to construct a monopole tower having antennas arranged to accommodate multiple carriers or providers, and yet which presents a reduced visual impact and affords independent control of the respective coverage areas.

DETAILED DESCRIPTION OF THE INVENTION

The invention is directed to an antenna system for wireless communications systems and, more particularly, to a monopole-mounted antenna system having an electrically-adjustable main beam direction and constituent antennas arranged side-by-side about a monopole tower so as to reduce the visual impact of the composite structure. Although the invention will be described next in connection with certain embodiments, it will be understood that the invention is not limited to those particular embodiments. On the contrary, the description of the invention is intended to cover all alternatives, modifications, and equivalent arrangements as may be included within the spirit and scope of the invention as defined by the appended claims.

Figure 1:
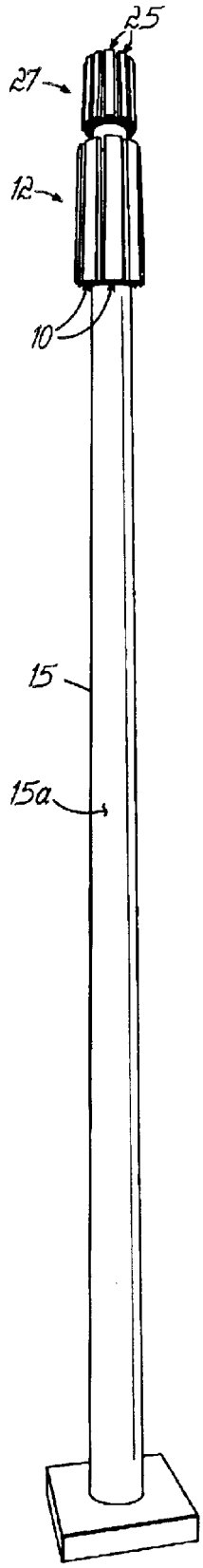
FIG. 1 is a perspective side view of a monopole tower and antennas in accordance with the principles of the invention.
Figure 1A:
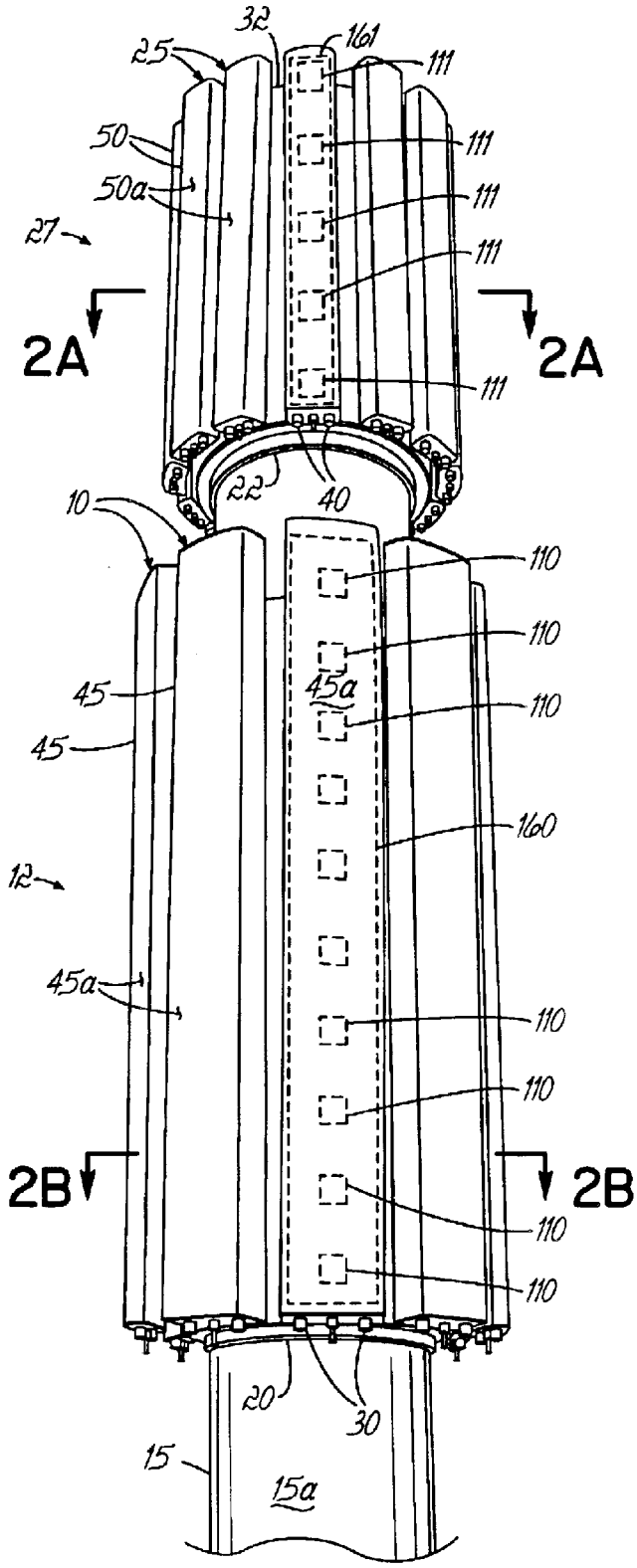
FIG. 1A is a perspective view of the top portion of FIG. 1.

With reference to FIGS. 1 and 1A, an antenna system according to the principles of the invention includes a monopole tower 15, a plurality of, for example, twelve antennas 10, arranged in a tier or group 12 about a circumference of the monopole tower 15, and a plurality of, for example, nine antennas 25 arranged in a tier or group 27 about a circumference of the monopole tower 15 at a greater height above ground level than group 12. Group 27 is positioned proximate to an apex 32 of the monopole tower 15. Antennas 10 are arranged with a side-by-side relationship in a group 12 spaced angularly about a cylindrical outer surface 15*a* of the monopole tower 15. Similarly, antennas 25 are arranged with a side-by-side relationship spaced angularly about outer surface 15*a*. The number of antennas 10 in group 12 and the number of antennas 25 in group 27 depend upon the diameter of the monopole tower 15 and the dimensions of the antennas 10, 25. The invention contemplates that the antennas 10 and antennas 25 may be of similar dimensions. For example, each of the groups 12, 27 may formed from a plurality of, for example, nine identical antennas arranged with a side-by-side relationship about the monopole tower 15.

Each of the antennas 10 is attached at one end by conventional fasteners to a lower mounting flange 20. Similarly, each of the antennas 25 is attached at one end by conventional fasteners to a lower mounting flange 22. Additional mounting flanges (not shown) may be provided for securing the antennas 10 in group 12 and the antennas 25 in group 27 to the outer surface 15*a* of monopole tower 15.

Each of the antennas 10 in group 12 includes a backplane 160, an array of, for example, ten radiating elements 110 disposed along a vertical dimension of backplane 160, and a radome 45. Similarly, each antenna 25 in group 27 includes a backplane 161, an array of, for example, five radiating elements 111 disposed along a vertical dimension of backplane 161, and a radome 50. Each of the antennas 10 may include a pair of electrical connectors 30 for electrically coupling radiating elements 110 via respective transmission cables (not shown) with a radio 55. Similarly, each of the antennas 25 is equipped with a pair of electrical connectors 40 configured to electrically couple with one end of respective transmission cables (not shown) for linking the radiating elements 111 of each antenna 25 with another radio (not shown). The individual radiating elements 110 and 111 may be any type of radiating element suitable for use in a wireless communication network configured for personal communication systems (PCS), personal communication networks (PCN), cellular voice communications, specialized mobile radio (SMR) service, enhanced SMR service, wireless local loop and rural telephony, and paging. For example, the individual radiating elements 110 and 111 may be monopole elements, dipole elements, loops, slots, spirals or helices, horns, or microstrip patches. The radiating elements 110 in each antenna 10 may be of the same or different type as radiating elements 111 in each antenna 25. In addition, the type of radiating elements 110 may differ among different antennas 10 or, similarly, the type of radiating elements 111 may differ among antennas 25. It is contemplated by the invention that additional groups of circumferentially-arranged antennas may be mounted to the monopole tower 15 in the same or similar manner to groups 12, 27 or that only one of group 12 or group 27 may be mounted to monopole tower 15.

With continued reference to FIGS. 1 and 1A, the side-by-side arrangement of the individual antennas 10 in group 12 and the individual antennas 25 in group 27 provides for a compact structure and de-emphasizes the visual impact of the individual antennas 10, 25 as the composite structure of each group 12, 27 has a smooth cylindrical-like appearance when compared with conventional monopole towers having triangular support platforms. The spacing between the confronting side edges of radomes 45 and radomes 50 is adequate to prevent touching and, in certain embodiments, may be as small as 1 to 2 millimeters. The inter-radome spacing between adjacent ones of antennas 10 and adjacent ones of antennas 25 is selected to minimize the perceptibility of seams.

Radome 45 and backplane 160 collectively define an outer housing that encloses the radiating elements 110 of each antenna 10. Typically, a radially-outermost surface 45*a* of each radome 45 and a radially-outermost surface 50*a* of each radome 50 has a convex curvature.

Figure 2A:
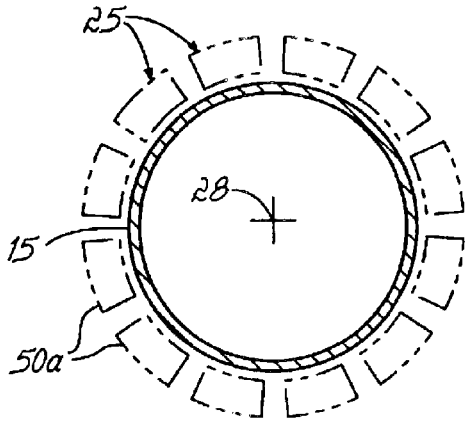
FIG. 2A is a sectional view taken generally along lines 2A-2A of FIG. 1A
Figure 2B:
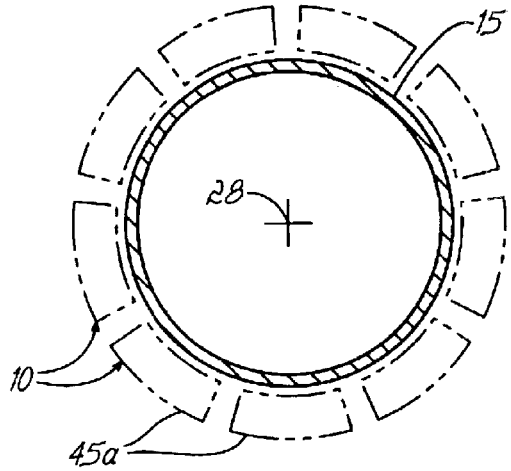
FIG. 2B is a sectional view taken generally along lines 2B-2B of FIG. 1A.
Figure 2C:
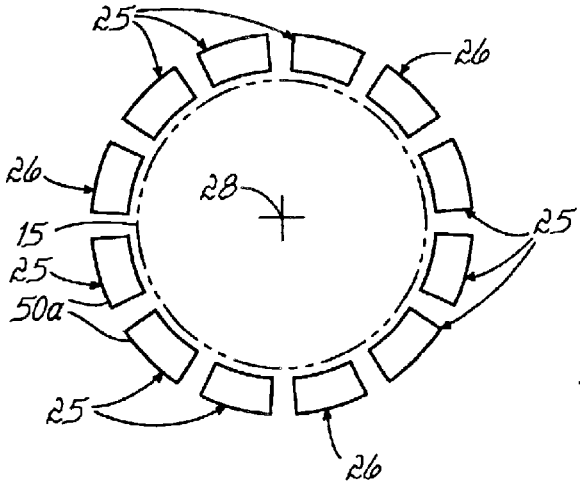
FIGS. 2C and 2D are sectional views similar to FIGS. 2A and 2B illustrating an alternative embodiment of the invention.

With reference to FIG. 2C in which like reference numerals refer to like features in FIGS. 1, 1A, and 2A, one or more filler housings 26 may be substituted for corresponding antennas 25 in group 27. Each filler housing 26 has comparable exterior dimensions to the radome 50 and backplane 161 of antenna 25 but lacks radiating elements. The filler housings 26 operate to maintain the reduced visual impact or appearance of group 27 by filling otherwise vacant locations between antennas 25 if group 27 includes less than its full complement of antennas 25. To that end, the filler housings 26 are mounted to the monopole tower 15 in a side-by-side relationship with adjacent antennas 25 or filler housings 26. Typically, the filler housings 26 will be spaced in group 27 about monopole tower 15 at equal angular spacings or in a pattern having an equal angular spacing. Filler housings 26 are illustrated in FIG. 2C replacing every fourth antenna 25 at 90° intervals about the circumference of monopole tower 15, although the invention is not so limited, as additional filler housings 26 may be introduced into group 27 so as to further reduce the number of antennas 25.

Figure 2D:
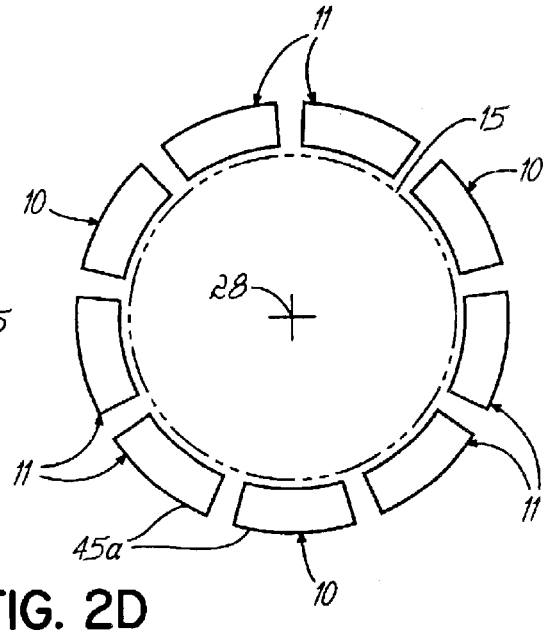

With reference to FIG. 2D in which like reference numerals refer to like features in FIGS. 1, 1A, and 2B, one or more filler housings 11 may replace any of the antennas 10 in group 12, as described herein with regard to group 27. Filler housings 11 occupy a majority of the available positions illustrated in FIG. 2D, although the invention is not so limited as additional antennas 10 may be substituted for certain of the filler housings 11. For example, three antennas 10 may replace three filler housings 11 that are separated by 120°.

With renewed reference to FIGS. 1 and 1A, the antennas 10 in group 12 may be subdivided into sets with each antenna 10 in a set covering, for example, 120° of cell coverage. Similarly, the antennas 25 in group 27 may be subdivided into sets with each antenna 25 in a set covering, for example, 120° of cell coverage. By way of specific example and not by way of limitation, the monopole tower 15 may have an outer diameter of about 26 inches on which a set of nine 900 MHz antennas is arranged in group 12 and a second set of twelve 1900 MHz antennas arranged in group 27. The set of nine 900 MHz antennas provides service for three wireless telephony providers and the set of twelve 1900 MHz antennas provides service for four wireless telephony providers. The diameter of the monopole tower 15 is selected to provide a stiffness suitable for resisting the wind load and the loading provided by the antennas 10, 25.

Radiating elements 110 and radiating elements 111 are arranged spatially for producing a directional radiation pattern. The main beam direction of the radiation pattern emanating from each of the antennas 10 in group 12 may be varied by altering the phase angle of the constituent radiating elements 110. Similarly, the main beam direction of the radiation pattern emanating from each antenna 25 in group 27 may be varied by altering the phase angle of the constituent radiating elements 111. The elevation or the azimuthal direction of the main beam may be controlled without the use of mechanical mechanisms to vary the physical orientation of the antennas 10, 25. The main beam direction of radiation pattern emanating from antennas 10 may be varied independently of the main beam direction of the radiation pattern emanating from antennas 25. Similarly, the main beam direction of radiation pattern emanating from a set of antennas 10 may be varied independently of the main beam direction of the radiation pattern emanating from a different set of antennas 10. Similarly, the main beam direction of radiation pattern emanating from a set of antennas 25 may be varied independently of the main beam direction of the radiation pattern emanating from a different set of antennas 25. The sets of antennas 10 or antennas 25 constitute a number of antennas smaller than the full complement of antennas. Each set of antennas 10 or set of antennas 25 services a single wireless telephony provider so that multiple providers may share a single group 12 or 27, respectively.

Figure 3:
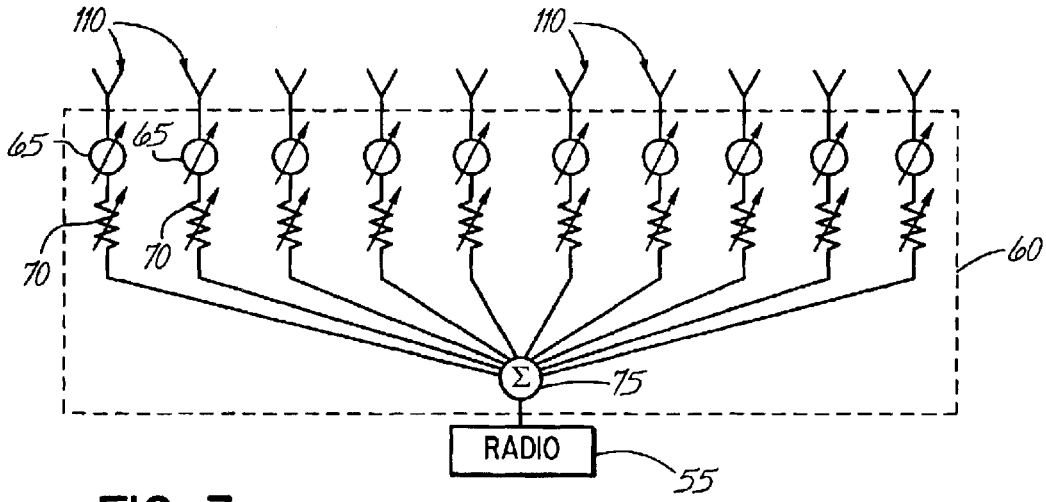
FIG. 3 is a diagrammatic view of an antenna.

With reference to FIG. 3, the antenna system includes a feed network 60 having a plurality of phase shifters 65, a plurality of attenuators 70, and a signal combiner/splitter 75 routes electrical signals between a radio 55 and radiating elements 110. The phase shifters 65 are operative for adjusting the main beam direction of the radiation pattern collectively emitted by radiating elements 110. It is appreciated by a person of ordinary skill in the art that the radiating elements 111 communicate with another radio (not shown but similar to radio 55) via a different feed network (not shown but similar to feed network 60. The phase shifters 65 function by varying the phase of the signal communicated between radio 55 and radiating elements 110, so as to steer the main beam direction of the radiation pattern by introducing phase delays in the signals driving the constituent radiating elements 110.

The phase shifters 65 may be actuated either electronically or mechanically. Electronic phase shifters may be based upon semiconductor diodes, monolithic microwave integrated circuits (MMIC), ferroelectric circuits, microelectromechanical systems (MEMS), and the like. Mechanical phase shifters may be based on coaxial transmission lines, stripline transmission lines, microstrip transmission lines, waveguide transmission lines, and the like and may be motor driven. Exemplary antenna systems featuring an adjustable main beam direction are disclosed in U.S. Pat. Nos. 6,346,924 and 6,198,458, the disclosure of each of which is hereby incorporated by reference herein in its entirety.

Figure 4:
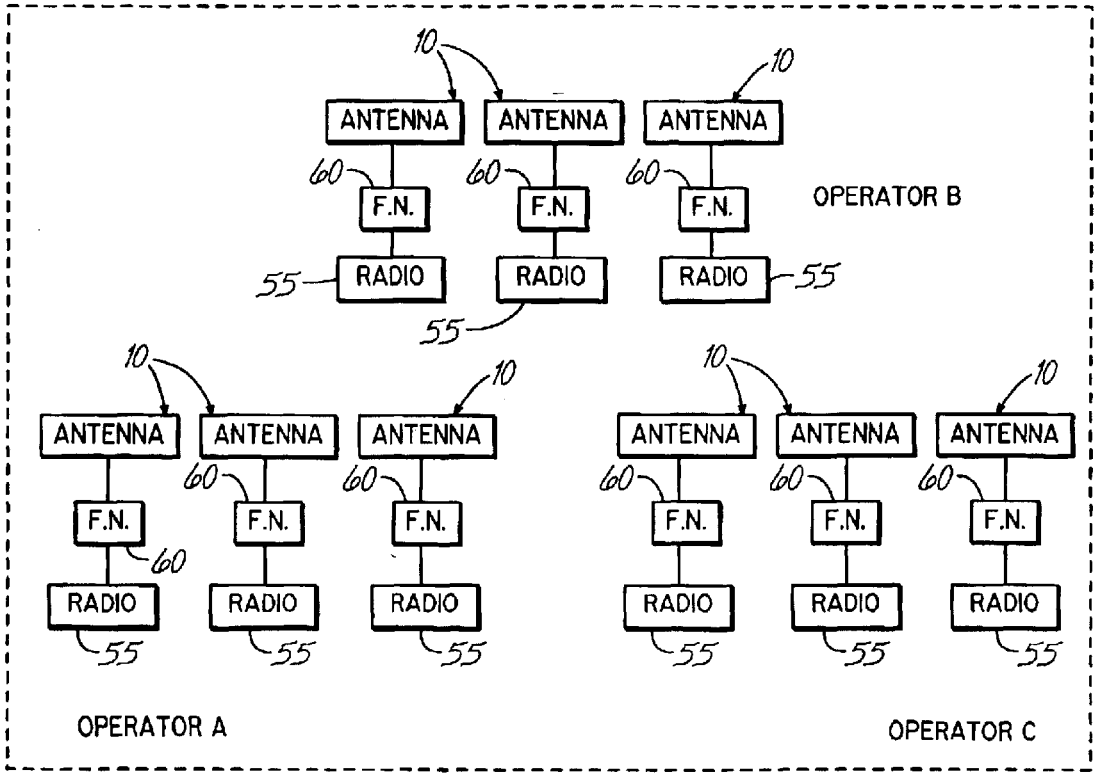
FIG. 4 is diagrammatic view of a group of antennas shared by three operators.

With reference to FIG. 4 and in accordance with one embodiment of the invention, each set of, for example, three antennas 10 may be coupled by corresponding feed networks 60 with a different operator's set of radios 55. As a result, each operator may vary their cell coverage by adjusting the phase shifters 65 of their associated feed networks 60 without impacting the operation of other operators sharing the group 12 of antennas 10. Antennas 25 may be coupled with one or more radios (not shown) in a similar manner and each operator using a set of antennas 25 may vary their individual cell coverage without impacting the operation of other providers using a different set of antennas 25 in group 27. In either case, each operator operates independently of other operators sharing the monopole tower 15 (FIG. 1) and equipment is not shared among the different operators sharing the monopole tower 15.

Because the main beam direction is varied without physically moving the corresponding antennas 10, 25, the visual appearance of each group 12, 27 is unchanged since the radomes 45, 50 have a fixed position relative to the monopole tower 15. It is contemplated by the invention that the radome 45 for group 12 and the radomes 50 for group 27 may each consist of one-piece or integral structures since the antennas 10, 25 remain static in position as the sector/cell coverage is varied by varying the phase angles of the individual radiating elements 110, 111.

Figure 5:
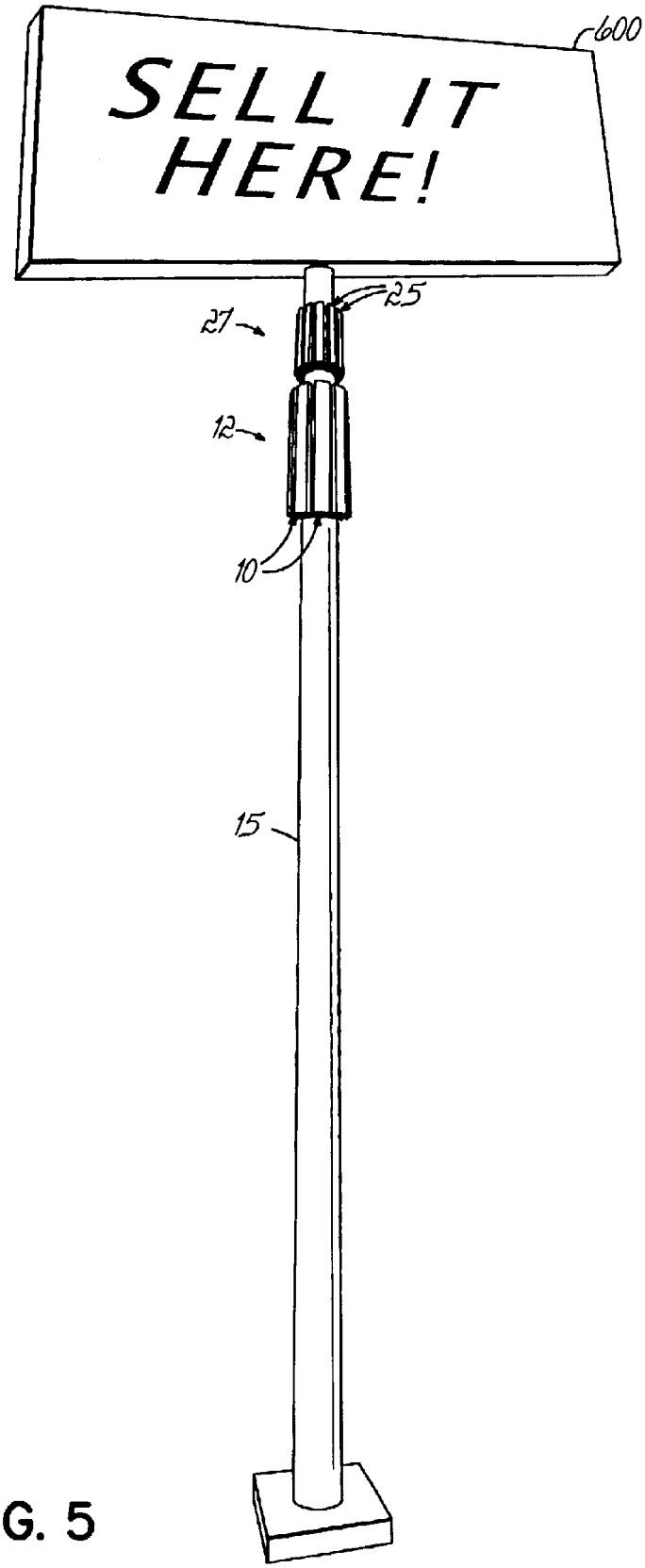
FIG. 5 is a perspective view of an alternative embodiment of a monopole tower and antennas in accordance with the principles of the invention.

According to another aspect of the invention and with reference to FIG. 5, monopole tower 15 may further include a visual display 600 of information for advertising or other information-conveying purposes. Typically, the visual display 600 is positioned atop the apex 32 of the monopole tower 15, although the invention is not so limited. For example, the visual display 600 may be attached using a suitable bracket or flange (not shown) at any height between the base and the apex 32 of the monopole tower 15. It is contemplated by the invention that the visual display 600 may constitute any suitable type of display mechanisms and may include illumination. Alternatively, the visual display 600 may be replaced by an light source for illuminating an area on the ground, such as a street, a tollway interchange, or a parking lot.

Figure 6:
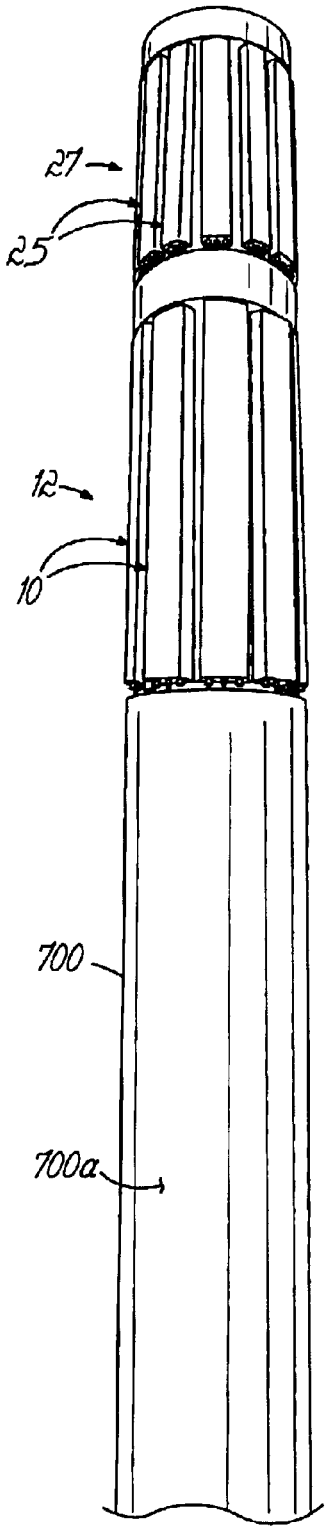
FIG. 6 is a perspective side view of a monopole tower and antennas in accordance with an alternative embodiment of the invention.
Figure 6A:
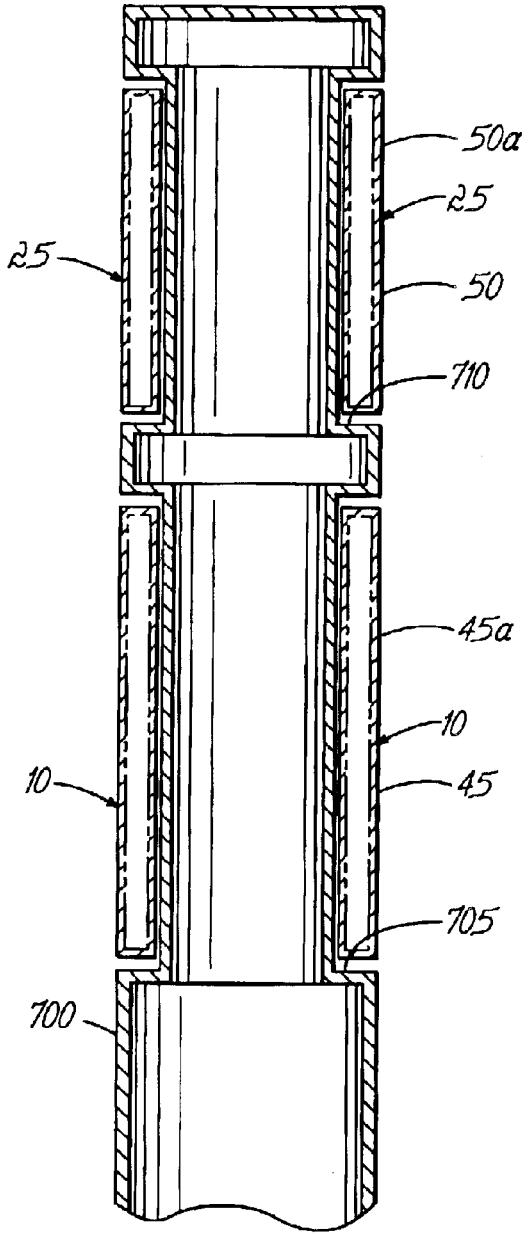
FIG. 6A is a sectional view of the monopole tower and antennas of FIG. 6.

With reference to FIGS. 6 and 6A in which like reference numerals refer to like features in FIGS. 1 and 1A and in accordance with an alternative embodiment of the invention, a monopole tower 700 may include a circumferential recess 705 dimensioned in a direction parallel to the height of the monopole tower 700 and in a circumferential direction sufficient to receive the antennas 10 of group 12. The radial depth of the recess 705 is effective to place the radially-outermost surface 45*a* of the radome 45 of each antenna 10 approximately flush with an outer surface 700*a* of the monopole tower 700. Similarly, another circumferential recess 710 similar to recess 705 may be provided for antennas 25 of group 27. The radial depth of the recess 705 is effective to place the radially-outermost surface 50*a* of the radome 50 of each antenna 25 approximately flush with an outer surface 700*a* of the monopole tower 700. The radially-outermost surfaces 45*a*, 50*a* have a convex curvature that is similar to the curvature of the outer surface 700*a*.

An antenna system constructed according to the principles of the invention has an aesthetically-pleasing appearance that increases public acceptance. As a result, the antenna system of the invention avoids or complies with zoning ordinances or other restrictive covenants of urban, suburban, and rural communities. In addition, the antenna system of the invention significantly reduces tower and site costs.

Moreover and in accordance with the principles of the invention, multiple providers may position antennas atop a single monopole tower and yet retain the ability to independently adjust the direction of the main radiation beam to change coverage by adjusting elevation and/or azimuth. The antenna system of the invention eliminates or, at the least, minimizes the problems of intermodulation that arise when more than one provider shares one set of antennas via diplexing and eliminates the additional losses incurred due to the use of a diplexer for combining or separating individual signals while optimizing the number of providers that may position antennas on a single monopole tower. The absolute number of monopole towers required to provide overlapping coverage areas for multiple providers may be reduced by the capability of sharing space on a monopole tower.

While the present invention has been illustrated by a description of various preferred embodiments and while these embodiments have been described in considerable detail in order to describe the best mode of practicing the invention, it is not the intention of the applicants to restrict or in any way limit the scope of the appended claims to such detail. Additional advantages and modifications within the spirit and scope of the invention will readily appear to those skilled in the art.

The invention itself should only be defined by the appended claims, wherein we claim:

1. An antenna system comprising:

a monopole tower having a circumference;

a plurality of first antennas each including at least one first radiating element operative for emitting a first radiation pattern;

a plurality of second antennas each including at least one second radiating element operative for emitting a second radiation pattern, said plurality of first antennas and said plurality of second antennas arranged with a side-by-side relationship about said circumference of said monopole tower;

a first feed network including a plurality of first phase shifters electrically coupled with said first radiating elements, said first feed network operative for varying a main beam direction of said first radiation pattern; and a second feed network including a plurality of second phase shifters electrically coupled with said second radiating elements, said second feed network operative for varying a main beam direction of said second radiation pattern independently of said main beam direction of said first radiation pattern.

2. The antenna system of claim 1 further comprising a visual information display attached to said monopole tower.

3. The antenna system of claim 2 wherein said monopole tower includes an apex, and said visual information display is attached to said apex of said monopole tower.

4. The antenna system of claim 1 wherein said first radiating elements differ from said second radiating elements.

5. An antenna system comprising:

a monopole tower;

a plurality of first antennas arranged with a side-by-side relationship about a first circumference of said monopole tower, each of said plurality of first antennas including at least one first radiating element operative for emitting a first radiation pattern;

a plurality of second antennas arranged with a side-by-side relationship about a second circumference of said monopole tower, each of said plurality of second antennas including at least one second radiating element operative for emitting a second radiation pattern;

a first feed network including a plurality of first phase shifters electrically coupled with said first radiating elements, said first feed network operative for varying a main beam direction of said first radiation pattern; and a second feed network including a plurality of second phase shifters electrically coupled with said second radiating elements, said second feed network operative for varying a main beam direction of said second radiation pattern independently of said main beam direction of said first radiation pattern.

6. The antenna system of claim 5 wherein said monopole tower includes an outer surface and a first circumferential recess dimensioned for receiving said plurality of first antennas, each of said plurality of first antennas having a radially-outermost surface that is substantially flush with said outer surface of said monopole tower.

7. The antenna system of claim 6 wherein said monopole tower includes an outer surface and a second circumferential recess dimensioned for receiving said plurality of second antennas, each of said plurality of second antennas having a radially-outermost surface that is substantially flush with said outer surface of said monopole tower.

8. The antenna system of claim 5 wherein said first radiating elements differ from said second radiating elements.

9. The antenna system of claim 5 further comprising at least one first filler housing disposed in a side-by-side relationship with said plurality of first antennas.

10. The antenna system of claim 9 further comprising at least one filler housing disposed in a side-by-side relationship with said plurality of second antennas.

11. An antenna system comprising:

a monopole tower having a circumference;

a plurality of first antennas each including at least one first radiating element operative for emitting a first radiation pattern;

a plurality of second antennas each including at least one second radiating element operative for emitting a second radiation pattern, said plurality of first antennas and said plurality of second antennas arranged with a side-by-side relationship about said circumference of said monopole tower;

a first feed network including a plurality of first phase shifters electrically coupled with said first radiating elements, said first feed network operative for varying a main beam direction of said first radiation pattern; and a second feed network including a plurality of second phase shifters electrically coupled with said second radiating elements, said second feed network operative for varying a main beam direction of said second radiation pattern independently of said main beam direction of said first radiation pattern, wherein said monopole tower further includes an outer surface and a circumferential recess dimensioned for receiving said plurality of antennas, each of said plurality of first antennas and said plurality of second antennas having a radially-outermost surface that is substantially flush with said outer surface of said monopole tower.

12. An antenna system comprising:

a monopole tower having a circumference;

a plurality of first antennas each including at least one first radiating element operative for emitting a first radiation pattern;

a plurality of second antennas each including at least one second radiating element operative for emitting a second radiation pattern, said plurality of first antennas and said plurality of second antennas arranged with a side-by-side relationship about said circumference of said monopole tower;

a first feed network including a plurality of first phase shifters electrically coupled with said first radiating elements, said first feed network operative for varying a main beam direction of said first radiation pattern;

a second feed network including a plurality of second phase shifters electrically coupled with said second radiating elements, said second feed network operative for varying a main beam direction of said second radiation pattern independently of said main beam direction of said first radiation pattern; and at least one filler housing disposed in a side-by-side relationship among said plurality of first antennas and said plurality of second antennas.

13. The antenna system of claim 12 wherein each of said plurality of first antennas and said plurality of second antennas includes a radome, and adjacent ones of said radomes have contiguous side edges.

14. The antenna system of claim 13 wherein said at least one filler housing has a radially outermost surface that is substantially flush with a radially outermost surface of said radomes.

15. An antenna system comprising:

a monopole tower including a circumference, an outer surface, and a first circumferential recess; and a plurality of first antennas arranged with a side-by-side relationship about said circumference of said monopole tower, said first circumferential recess of said monopole tower being dimensioned for receiving said plurality of first antennas, at least one of said plurality of first antennas having a radially-outermost surface that is substantially flush with said outer surface of said monopole tower.

16. The antenna system of claim 15 further comprising:

a plurality of second antennas, said plurality of first antennas and said plurality of second antennas arranged with a side-by-side relationship about said circumference of said monopole tower, and the first circumferential recess of said monopole tower being dimensioned for receiving said plurality of first antennas and said plurality of second antennas, at least one of said plurality of second antennas having a radially-outermost surface that is substantially flush with said outer surface of said monopole tower.

17. The antenna system of claim 15 wherein said monopole tower includes a second circumferential recess, and further comprising:

a plurality of second antennas arranged with a side-by-side relationship about said circumference of said monopole tower, and the second circumferential recess of said monopole tower being dimensioned for receiving said plurality of second antennas, at least one of said plurality of second antennas having a radially-outermost surface that is substantially flush with said outer surface of said monopole tower.

18. An antenna system comprising:

a monopole tower;

a plurality of first antennas arranged in a side-by-side relationship about said monopole tower;

a plurality of second antennas positioned above the first antennas, the plurality of second antennas arranged in a side-by-side relationship about said monopole tower; and at least one filler housing disposed in a side-by-side relationship among said plurality of first antennas and said plurality of second antennas.

* * * * *

UNITED STATES PATENT AND TRADEMARK OFFICE

CERTIFICATE OF CORRECTION

PATENT NO. : 6,999,042 B2 
APPLICATION NO. : 10/377832
DATED : February 14, 2006
INVENTOR(S) : Russell W. Dearnley et al.

It is certified that error appears in the above-identified patent and that said Letters Patent is hereby corrected as shown below:

Title Page

At [56], U.S. Patent Documents insert --5,375,353 A 12/1994 Hulse 40/217--

Insert at item [56] Foreign Patent Documents

| | | |
|---|---|---|
| --WO | 97/44914 | 11/27/1997 |
| NL | 1016528 | 7/1/2002 |
| DE | 201 20 367 U1 | 12/19/2002 |
| DE | 202 03 023 U1 | 7/25/2002 |
| WO | 98/53522 | 11/26/1998-- |

At [56], Other Publications insert --European Patent Office, European Search Report Dated 22 June 2004

Village, J.A. et al., 3G Shared Infrastructure, International Conference on 3G Mobile Communication Technologies, 8 May 2002, pgs. 10-16--

At Item [56] Other Publications, "Jimenez Sanchez et al. reference, "2001/OD13212" should read -- 2001/0013212 --.

Signed and Sealed this

First Day of August, 2006

JON W. DUDAS
*Director of the United States Patent and Trademark Office*